US009266125B2

(12) United States Patent
McLoughlin, Jr.

(10) Patent No.: US 9,266,125 B2
(45) Date of Patent: Feb. 23, 2016

(54) NOZZLE WITH COMBINATION PRESURE-RELIEF AND COOLING VALVE

(71) Applicant: John E. McLoughlin, Jr., Saint Charles, MO (US)

(72) Inventor: John E. McLoughlin, Jr., Saint Charles, MO (US)

( * ) Notice: Subject to any disclaimer, the term of this patent is extended or adjusted under 35 U.S.C. 154(b) by 525 days.

(21) Appl. No.: 13/680,075

(22) Filed: Nov. 18, 2012

(65) Prior Publication Data

US 2014/0138565 A1 May 22, 2014

(51) Int. Cl.

| | |
|---|---|
| ***A62C 31/00*** | (2006.01) |
| ***B05B 1/16*** | (2006.01) |
| ***B05B 1/32*** | (2006.01) |
| ***B05B 9/01*** | (2006.01) |
| ***B05B 1/30*** | (2006.01) |
| ***A62C 33/00*** | (2006.01) |

(Continued)

(52) U.S. Cl.

CPC ..... *B05B 1/1663* (2013.01); *A62C 31/02* (2013.01); *A62C 31/22* (2013.01); *A62C 33/00* (2013.01); *B05B 1/16* (2013.01); *B05B 1/1627* (2013.01); *B05B 1/1645* (2013.01); *B05B 1/1654* (2013.01); *B05B 1/1681* (2013.01); *B05B 1/302* (2013.01); *B05B 1/3006* (2013.01); *B05B 1/3026* (2013.01); *B05B 1/323* (2013.01); *B05B 9/01* (2013.01); *Y10S 239/04* (2013.01)

(58) Field of Classification Search

CPC ..... B05B 1/1627; B05B 1/1681; B05B 1/16; B05B 1/1645; B05B 1/1654; B05B 1/323; B05B 9/01; B05B 1/302; B05B 1/3026; B05B 1/3006; B05B 1/00; B05B 1/1663; A62C 33/00; A62C 31/22; A62C 31/02; A62C 2/08; F16K 17/06; Y10S 239/04

USPC ..... 169/48, 70; 239/437, 440, 441, 443, 239/444, 449, 452, 537–541, 525, 570, 571, 239/533.1, 589, DIG. 4

See application file for complete search history.

(56) References Cited

U.S. PATENT DOCUMENTS 3,190,563 A * 6/1965 De Groot ..... 239/443
3,463,181 A * 8/1969 Hastings ..... 137/494

(Continued)

FOREIGN PATENT DOCUMENTS

DE 1274402 8/1968

*Primary Examiner* — Steven J Ganey
(74) *Attorney, Agent, or Firm* — Louise S. Heim

(57) ABSTRACT

A firefighting nozzle is provided with a relief valve assembly that opens to discharge a fine spray or "curtain" of liquid extending 360° around the nozzle, thus cooling off the nozzle operator and the surrounding area, while at the same preventing dangerous pressure build-up in the nozzle. In a preferred embodiment, the relief valve assembly comprises a housing having a substantially cylindrical side wall defining a bore. A tubular sleeve divides the bore into two parts: a cylindrical inner passage defining the primary flow path for liquid traveling through the nozzle; and an annular space defining a valve chamber. A plurality of relief ports is formed in a 360° degree pattern around the side wall of housing, each relief port defining a secondary flow path extending substantially perpendicularly to the primary flow path. An annular plug is mounted for sliding movement on the inner sleeve, from a first position blocking the relief ports to a second position allowing flow therethrough. A compression spring or other biasing element is provided for normally urging the plug toward the first position. When liquid entering the nozzle exerts enough pressure on the inlet end of the annular plug to overcome the force of the biasing element, the annular plug moves away from the relief plugs, thereby allowing liquid to escape through the relief ports, simultaneously reducing the pressure inside the nozzle as well as the air temperature outside the nozzle.

15 Claims, 1 Drawing Sheet

(51) Int. Cl.
*A62C 31/02* (2006.01)
*A62C 31/22* (2006.01)

(56) References Cited

U.S. PATENT DOCUMENTS 3,786,869 A 1/1974 McLoughlin
4,189,005 A 2/1980 McLoughlin
4,485,877 A * 12/1984 McMillan et al. ..... 169/48
5,261,494 A 11/1993 McLoughlin et al.
5,447,203 A 9/1995 McLoughlin et al.
5,590,719 A 1/1997 McLoughlin et al.
5,888,051 A 3/1999 McLoughlin et al.
7,416,223 B1 * 8/2008 Sulmone ..... 285/13

* cited by examiner

NOZZLE WITH COMBINATION PRESURE-RELIEF AND COOLING VALVE

BACKGROUND

1. Field of the Invention

This invention relates to the art of firefighting equipment.

More particularly, the invention relates to a nozzle for dispensing liquid from a fire hose.

In a further and more specific aspect, the instant invention concerns a nozzle having a valve that acts simultaneously to prevent excessive pressure build-up in the nozzle, and to create a curtain of liquid for cooling the nozzle operator and the surrounding environment.

2. Description of the Prior Art

Firefighters who operate hand-held nozzles are at constant risk of injury from the reaction forces generated when high-pressure liquid is discharged from those nozzles. Very often these forces cause whipping motions or other unwanted movements that can cause the firefighter to drop the nozzle, lose balance, and even be thrown off a ladder or a ledge.

In addition to the danger presented by high reaction forces, the firefighter must cope with the extremely high temperatures created by the fire itself. Not only is the air around the fire uncomfortably hot, but any equipment, vehicles, or structures in the vicinity also heat up, and can scorch or scald any firefighters or bystanders who inadvertently come into contact with these items. Accordingly, there is a need for a cooling system that can reduce the ambient temperature of the fire scene.

Various attempts have been made to solve the problem of high reaction forces. For instance, engine-driven pumps are often controlled by governors which respond to increases in discharge pressure by decreasing the rpm of the engine. In addition, some nozzles have trigger-operated valves where the strength of the operator's grip determines the discharge pressure. However, none of the existing systems are foolproof, and many are expensive.

The problem of high ambient temperature is alleviated to an extent by certain nozzles that incorporate a "fog generation" feature that allows them to emit a conical spray of evenly distributed water droplets. This spray spreads over a relatively wide area, forming a cool, protective shroud in front of the nozzle operator. However, because this spray is forwardly directed, it does little to cool the areas directly alongside or behind the operator.

It would be highly advantageous, therefore, to remedy the foregoing and other deficiencies inherent in the prior art.

OBJECTS OF THE INVENTION

Accordingly, it is an object of the present invention to provide a relief valve for preventing the discharge pressure of a firefighting nozzle from reaching excessively high levels.

Another object of the invention is the provide a firefighting nozzle with means for reducing the reaction forces of liquid discharged therefrom.

Yet another object of the invention is to provide a firefighting nozzle with a mechanism for cooling the immediate area around the nozzle.

A further object of the invention is to provide a firefighting nozzle according to the foregoing, that is relatively inexpensive to manufacture and comparatively simple and easy to use.

SUMMARY OF THE INVENTION

Briefly, to achieve the desired objects of the instant invention in accordance with the preferred embodiment thereof, a firefighting nozzle is provided with a relief valve assembly that opens to discharge a fine spray or "curtain" of liquid extending 360° around the nozzle, thus cooling off the nozzle operator and the surrounding area, while at the same preventing dangerous pressure build-up in the nozzle.

More specifically, the relief valve assembly comprises a housing having a substantially cylindrical side wall defining a bore. A tubular sleeve divides the bore into two parts: a cylindrical inner passage defining the primary flow path for liquid traveling through the nozzle; and an annular space defining a valve chamber. A plurality of relief ports is formed in a 360° degree pattern around the side wall of housing, each relief port defining a secondary flow path extending substantially perpendicularly to the primary flow path. An annular plug is mounted for sliding movement on the inner sleeve, from a first position blocking the relief ports to a second position allowing flow through the relief ports. A compression spring or other biasing element is provided for normally urging the plug toward the first position. When liquid entering the nozzle exerts enough pressure on the inlet end of the annular plug to overcome the force of the biasing element, the annular plug moves away from the relief plugs, thereby allowing liquid to escape through the relief ports, simultaneously reducing the pressure inside the nozzle as well as the air temperature outside the nozzle.

BRIEF DESCRIPTION OF THE DRAWINGS

The foregoing and further and more specific objects of the instant invention will become readily apparent to those skilled in the art from the following detailed description of the preferred embodiment thereof taken in conjunction with the drawings in which.

DESCRIPTION OF THE PREFERRED EMBODIMENT

Figure 1:
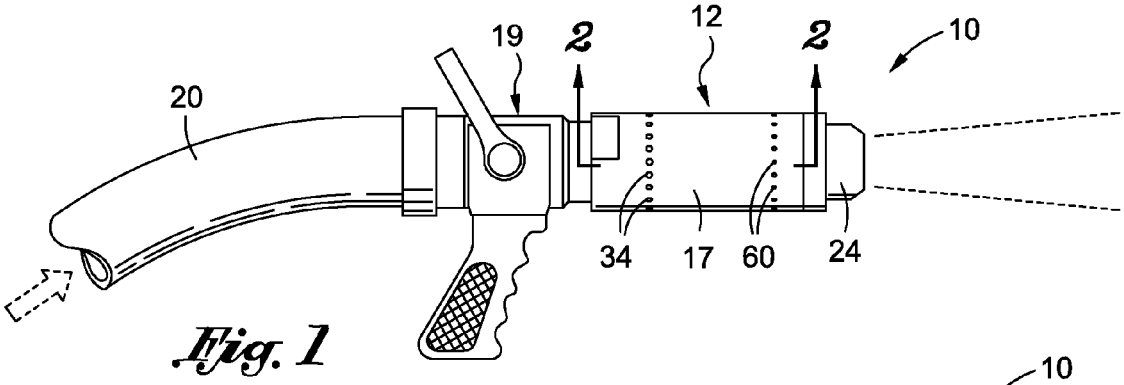
FIG. 1 is a perspective view showing the combination relief and cooling valve assembly of the instant invention attached to the outlet end of a conventional fire hose.

Referring more particularly to the drawings, the combination relief and cooling valve assembly of the instant invention, indicated in its entirety by the numeral 10, comprises a housing 12 having an inlet end 14, an outlet end 16, and a substantially cylindrical side wall 17. The inlet end 14 is provided with first coupling means such as an internally threaded neck 18 for securing the assembly 10 to a valve 19 at the end of a fire hose 20. The outlet end 16 may be provided with second coupling means such as an externally threaded neck 22 for securing the assembly 10 to a detachable spray tip 24 as illustrated or, alternatively, could be formed integrally with the spray tip.

The side wall 17 of the housing 12 defines a bore 26 that extends generally coaxially with the valve 19 when secured thereto. A tubular inner sleeve 28 divides the bore 26 into two parts: a cylindrical inner passage 30 defining the primary flow path A for liquid traveling through the nozzle; and an annular space defining a valve chamber 32. A plurality of relief ports 34 is formed in a 360° degree pattern around the side wall of housing 12, each relief port 34 defining a secondary flow path B that extends substantially perpendicularly to the primary flow path. The relief ports 34 are preferably sized and configured so that liquid exiting the ports 34 is in the form of a fine spray.

The diameter of the bore 26 is substantially equal to the diameter of the hose 12 *a* the inlet end of the housing and gradually increases over a short distance, defining a substantially conical throat portion 36 that terminates at an annular valve seat 38 formed slightly upstream of the relief ports 34.

An annular plug 40 is mounted for sliding movement along the inner sleeve 38. The plug 40 is normally urged against the valve seat 38 by biasing means such as a compression spring 42 that extends between the plug 40 and a stop surface 44 formed at the outlet end 16 of the housing 12. In the illustrated embodiment, the stop surface 44 is the inlet side of a threaded flange 46 which extends radially outwardly from the inner sleeve 28, coupling the sleeve 28 in a fixed, inwardly spaced relationship relative to the side wall 17 of the housing 12.

A first O-ring 48 positioned in an annular groove formed at the inlet end 50 of the annular plug 40 forms a seal between the annular plug 40 and the valve seat 38 when the valve assembly 12 is in its closed configuration. A second O-ring 52 positioned in an annular groove formed in the inner side wall 54 of the plug 40 forms a seal between the plug 40 and the sleeve 28. A third O-ring 56 positioned in an annular groove in the outer side wall 58 of the plug 40 forms a seal between the plug 40 and the side wall 17 of the housing 12. Any liquid entering the valve chamber 32 despite the O-rings 48, 52, and 56 is allowed to escape through drainage ports 60 formed in the side wall 17 of the housing downstream of the relief ports 34, thereby allowing the compression spring to operate freely within the chamber 32.

Figure 2:
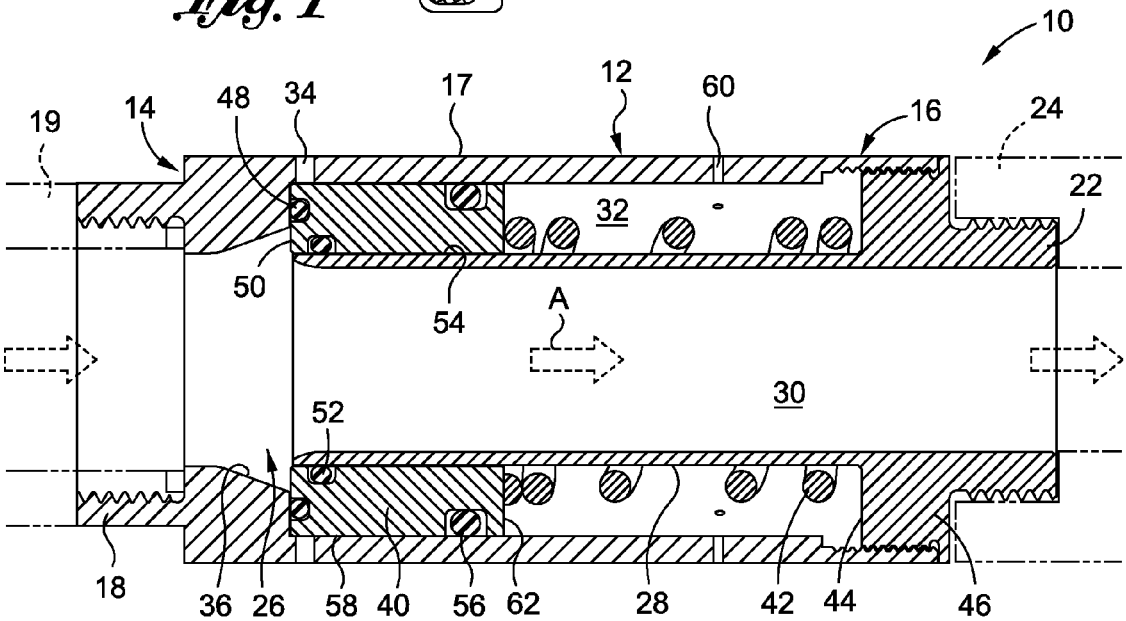
FIG. 2 is a cross-sectional view taken through line 2-2 of FIG. 1, showing the valve assembly in a closed configuration.
Figure 3:
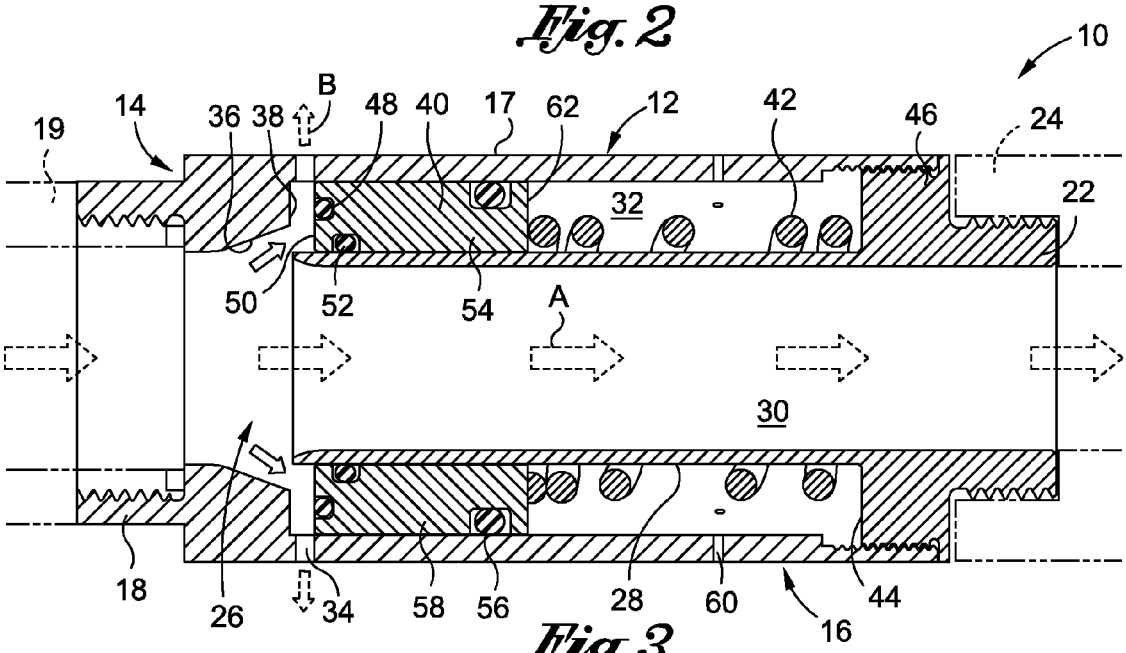
FIG. 3 is a cross-sectional view similar to FIG. 2, showing the valve assembly in an open configuration.

FIG. 2 shows the assembly 10 in its normal, or closed, position. The relief ports 34 are blocked by the annular plug 30 so all the liquid from the valve 19 flows along the primary flow path A through the inner sleeve 28 and is discharged through the spray tip 24. When pressure exerted by the liquid against the inlet end 50 of the annular plug exceeds the force exerted by the spring 42 on the outlet side 62 of the plug 40, the plug is pushed in a downstream direction, unblocking the relief ports 34 and allowing a small amount of liquid to exit along the secondary flow paths B through the relief ports 34 as shown in FIG. 3. The force of the spring 42 will have been selected such that the valve opens at a predetermined value selected to prevent excessive and dangerous nozzle movement, while at the same time generating enough force to "punch through" fires and burning debris. Typically, this is in the vicinity of 60 psi.

In addition to preventing the reaction forces of the discharge stream from reaching dangerously high levels, the nozzle assembly 12 of the present invention has the added benefit of creating a liquid curtain around the nozzle. Water discharged through the relief ports will be directed 360° around the housing, thus cooling the nozzle operator and surrounding equipment.

While the principles of the invention have now been made clear in the illustrated embodiments, there will be immediately obvious to those skilled in the art many modifications of structure, arrangements, proportions, elements, materials, and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A nozzle assembly for dispensing liquid from a hose, comprising:

a) a housing having an inlet, an outlet end, and a substantially cylindrical side wall defining a longitudinally extending bore, the side wall including a plurality of circumferentially spaced-apart relief ports extending substantially radially therethrough; and b) a control system configured to block said relief ports when the pressure of liquid exiting the hose is at or below a predetermined level and to move away from said relief ports when the pressure exceeds said predetermined level, allowing liquid to escape through said relief ports and to create a cooling curtain around the nozzle assembly, the control system including a substantially annular valve seat formed at the inlet end of said housing, a substantially annular plug is mounted for sliding movement on a tubular inner sleeve extending longitudinally within the bore of the nozzle, and c) means for urging said substantially annular plug against said substantially annular valve seat.

2. A nozzle assembly according to claim 1, further comprising means for maintaining said inner sleeve in a fixed position relative to, and radially inwardly of, the side wall of the housing.

3. A nozzle assembly according to claim 2, wherein the means for maintaining said inner sleeve in a fixed position comprises a flange extending radially between the inner sleeve and the side wall of the housing.

4. A nozzle assembly according to claim 3, wherein the means for urging said substantially annular plug against said substantially annular valve seat comprises a compression spring extending between said flange and said plug.

5. A nozzle assembly according to claim 1, further comprising a first seal positioned between the valve seat and the inlet end wall of the annular plug and configured to prevent leakage between the valve seat and the plug.

6. A nozzle assembly according to claim 1, wherein said relief ports are sized and configured so that liquid exits said ports in the form of a fine spray.

7. A nozzle assembly comprising:

a) a housing having an inlet end and an outlet end, and a substantially cylindrical side wall defining a bore serving as a primary flow path for a liquid, the side wall including a plurality of circumferentially spaced-apart relief ports extending substantially perpendicularly with respect to the said primary flow path;

b) a substantially annular valve seat formed at the inlet end of said housing;

c) a tubular inner sleeve mounted in radially inwardly spaced relationship with respect to the side wall of the housing, the space between the inner sleeve and the side wall defining an annular chamber d) a flange extending radially between the inner sleeve and the housing to maintain the sleeve in a fixed position relative to the housing;

e) an annular plug mounted for sliding movement on said inner sleeve, the annular plug having an inlet end wall, an outlet end wall and a cylindrical side wall; and f) a compression spring extending between said flange and the outlet end wall of the plug, the spring being designed to urge said plug against said valve seat when pressure exerted by liquid on the inlet end wall of the plug is at or below a predetermined level and to compress when pressure exerted by liquid on the inlet end wall of the plug exceeds said predetermined level thereby allowing said plug to slide away from said relief ports, allowing liquid to escape and create a cooling curtain around the nozzle assembly.

8. A nozzle assembly according to claim 7, further comprising means for attaching the assembly to the discharge end of a fire hose.

9. A nozzle assembly for dispensing liquid from a hose, comprising:

a) a housing having an inlet, an outlet end, and a substantially cylindrical side wall defining a longitudinally extending bore, the side wall including a plurality of circumferentially spaced-apart relief ports extending substantially radially therethrough; and b) a control system configured to block said relief ports when the pressure of liquid exiting the hose is at or below a predetermined level and to move away from said relief ports when the pressure exceeds said predetermined level, allowing liquid to escape through said relief ports and to create a cooling curtain around the nozzle assembly, the control system including a substantially annular valve seat formed at the inlet end of said housing, a tubular inner sleeve mounted in radially inwardly spaced relationship with respect to the side wall of the housing, the space between the inner sleeve and the side wall defining an annular chamber, and an annular plug mounted for sliding movement on said inner sleeve, the annular plug having an inlet end wall, an outlet end wall, and a cylindrical side wall; and c) means for urging said substantially annular plug against said substantially annular valve seat.

10. A nozzle assembly according to claim 9, wherein the control system further comprises a flange extending radially outwardly from the inner sleeve to maintain the sleeve in a fixed position relative to the side wall of the housing.

11. A nozzle assembly according to claim 10, wherein the means for urging said substantially annular plug against said substantially annular valve seat includes a compression spring extending between said flange and the outlet end wall of the plug, the spring being designed to compress when pressure exerted by liquid on the inlet end wall of the plug exceeds said predetermined level, thereby allowing said plug to slide away from said relief ports.

12. A nozzle assembly according to claim 9, further comprising a first seal positioned between the valve seat and the inlet end wall of the annular plug and configured to prevent leakage between the valve seat and the plug.

13. A nozzle assembly according to claim 9, further comprising a second seal positioned between the plug and the side wall of the housing and configured to prevent leakage of fluid into the annular chamber.

14. A nozzle assembly according to claim 9, further comprising a third seal positioned between the plug and the inner sleeve.

15. A nozzle assembly according to claim 9, further comprising at least one drainage port formed in the side wall of the housing downstream of said relief ports for allowing liquid to escape from said annular chamber.

* * * * *